US005797535A

United States Patent [19]

Lovegrove et al.

[11] Patent Number: 5,797,535

[45] Date of Patent: Aug. 25, 1998

[54] STAPLER WITH STORAGE COMPARTMENT AND COVER SLIPPER

[75] Inventors: Ross Nigel Lovegrove; Luke Neil Pearson; Peter Granville Russell-Clarke, all of London, England

[73] Assignee: Acco USA, Inc., Wheeling, Ill.

[21] Appl. No.: 855,955

[22] Filed: May 14, 1997

[51] Int. Cl.[6] ..... B25C 5/02; B27F 7/00

[52] U.S. Cl. ..... 227/120; 227/134; 227/156

[58] Field of Search ..... 227/120, 127, 227/128, 134, 123, 156

[56] References Cited

U.S. PATENT DOCUMENTS

| | | |
|---|---|---|
| D. 352,433 | 11/1994 | Smith . |
| 1,663,242 | 3/1928 | Crofoot . |
| 2,368,552 | 1/1945 | La Place . |
| 2,726,393 | 12/1955 | Vogel . |
| 3,289,910 | 12/1966 | Lescure . |
| 3,302,842 | 2/1967 | MacEachron . |
| 3,640,443 | 2/1972 | Itagaki . |
| 3,665,580 | 5/1972 | Mashita . |
| 4,114,793 | 9/1978 | Hsu . |
| 4,240,572 | 12/1980 | Mitsuhashi . |
| 4,288,018 | 9/1981 | Taniguchi . |
| 4,405,073 | 9/1983 | Escalante . |
| 4,491,261 | 1/1985 | Mitsuhashi . |
| 4,619,392 | 10/1986 | Won . |
| 4,727,610 | 3/1988 | Lin . |
| 4,762,262 | 8/1988 | Ming . |
| 4,949,893 | 8/1990 | Heckathorn . |

*Primary Examiner*—Scott A. Smith
*Attorney, Agent, or Firm*—Pennie & Edmonds LLP

[57] ABSTRACT

A stapler having a storage compartment in the bottom of the stapler and a slipper removably attached over the storage compartment. The slipper further extends around the end of the stapler and has a top portion connected to the head of the stapler.

10 Claims, 4 Drawing Sheets

STAPLER WITH STORAGE COMPARTMENT AND COVER SLIPPER

BACKGROUND OF THE INVENTION

Staplers with storage capabilities for extra staples are disclosed, as for example, in U.S. Pat. No. 1,663,242. Also, staplers with a storage capability and a removable cover for the storage compartment are available and disclosed, as for example, in U.S. Pat. No. 4,491,261.

SUMMARY OF THE INVENTION

The present invention is an improvement in staplers with storage capabilities for extra items. In accordance with the invention, the bottom of the base of the stapler is recessed to provide a storage chamber or compartment and this compartment is covered by a removable slipper. The slipper is constructed of flexible material so as to frictionally engage the base of the stapler. It is thus removably attachable in overlying relation to the storage compartment. The slipper also includes a portion which loops around the hinged end of the stapler and is attached to the top surface of the head of the stapler. Accordingly, when the slipper is removed from the base of the stapler to expose the storage compartment, it remains attached to the stapler, whereby loss or misplacement of the slipper is avoided.

DETAILED DESCRIPTION OF THE INVENTION

Figure 1:
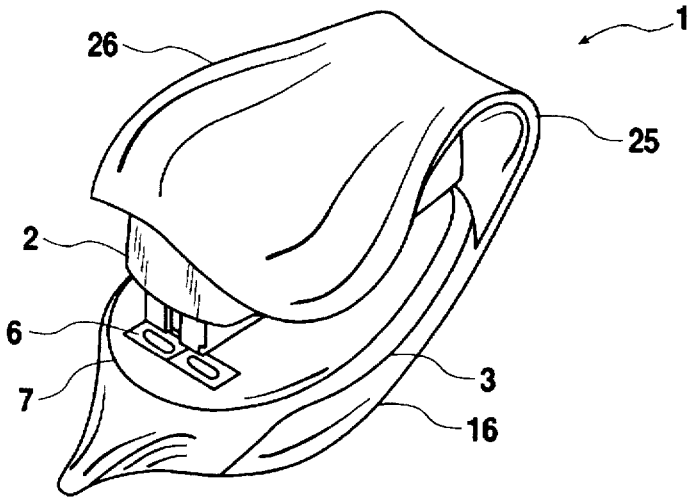
FIG. 1 is a perspective view of the stapler of the present invention.
Figure 2:
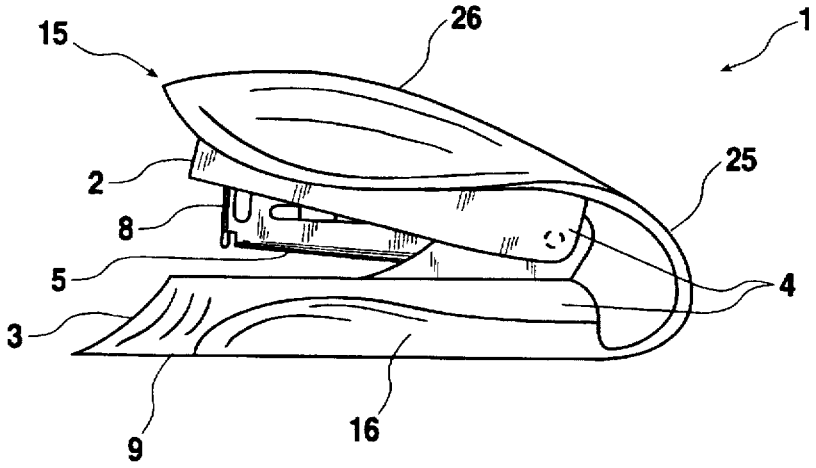
FIG. 2 is a side view of the stapler.
Figure 3:
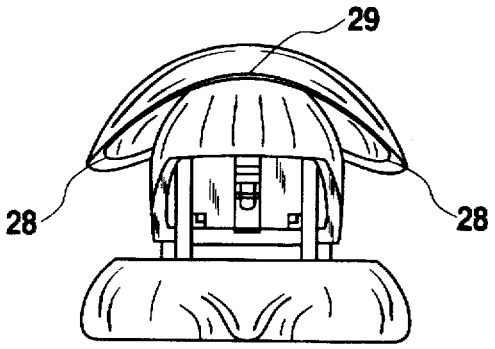
FIG. 3 is a front view of the stapler.
Figure 4:
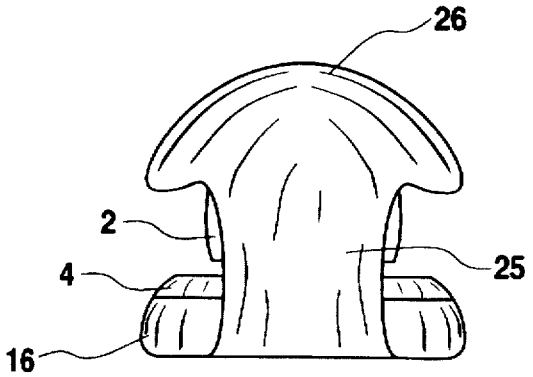
FIG. 4 is a rear view of the stapler.
Figure 5:
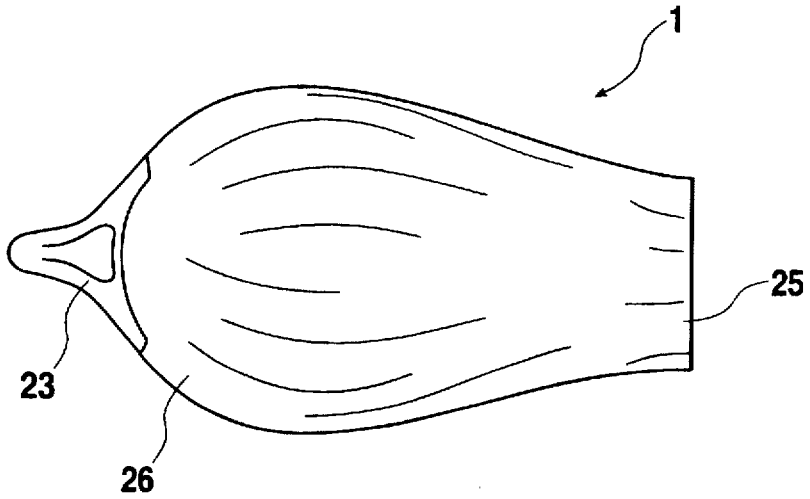
FIG. 5 is a bottom view of the stapler.

The stapler 1 includes a head 2 and a base 3 pivotally connected to each other at one end 4 of the stapler. The head includes a housing or magazine 5 for holding a supply of staples. The base, in turn, has the conventional die 6 against which individual staples engage during the stapling operation. As shown in the drawings, the die 6 is located in the top 7 of the base so as to face the head and the forward end 8 of the staple magazine.

The head and base of the stapler are formed of relatively rigid non-brittle plastic, such as acrylonitrile-butadiene-styrene (A.B.S.). The head also includes the conventional plunger mechanism for pushing individual staples out the forward end 8 of the staple storage magazine 5, during a stapling operation. This plunger mechanism, which is not shown in the drawings, is attached to the under surface of the top of the head in overlying relation with the staple magazine 5.

Figure 9:
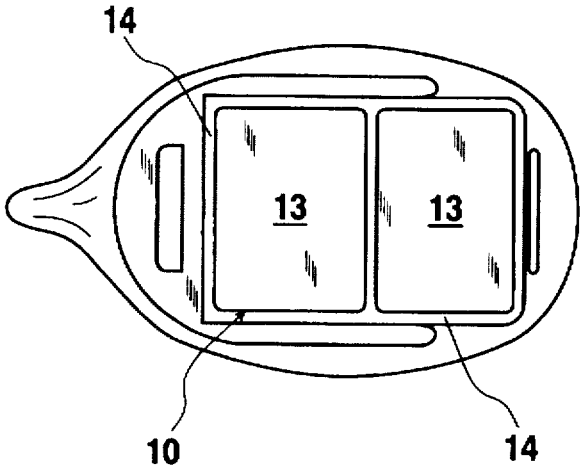
FIG. 9 is a bottom view of the stapler showing a modified storage compartment configuration.
Figure 8:
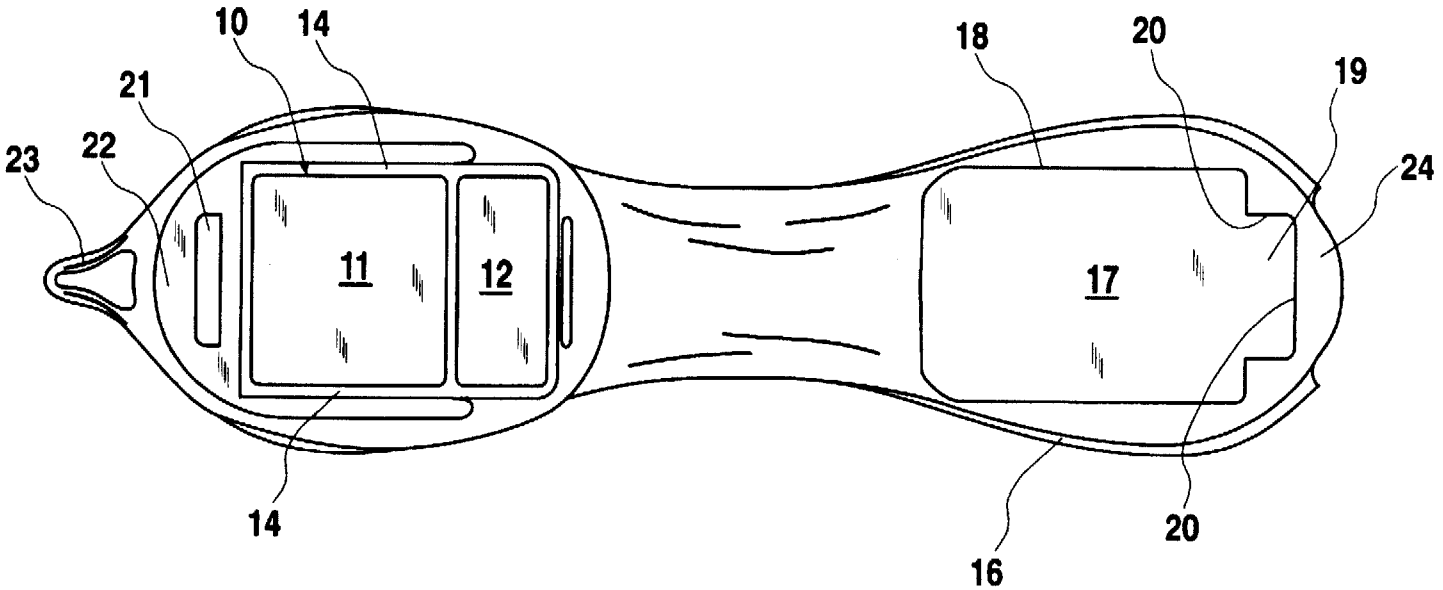
FIG. 8 is a bottom view of the stapler with the cover portion of the slipper removed from the storage compartment.

The bottom 9 of the base 3 is provided with a storage compartment 10 (FIGS. 8 and 9). In FIG. 8, the storage compartment is divided into two sections 11 and 12. Section 11 is about half the size of section 12. The storage compartment shown in the embodiment of FIG. 9 is divided into two sections 13 of equal dimension. Each of these compartments can be used to store staples or other items, as desired. In each construction, the storage compartment is bounded by a peripheral wall 14. The height of the wall is preferably slightly greater than the height of the staples to be stored in the compartment.

In accordance with the invention, a slipper 15 is provided for purposes of closing the storage compartment, so as to retain the items placed therein. The slipper is constructed of a flexible compressible material, such as a thermoplastic elastomer, available from Kraton under #G2755. Preferably, the material has a rubber-like feel and a Shore hardness of A40-50. Also, in the preferred embodiment, the slipper is constructed of semi-translucent material and in a color compatible with the color of the stapler head and base.

As shown in the drawings, the slipper includes a cover portion 16 overlying and closing the storage compartment 10. For this purpose, the cover portion 16 includes a recessed area 17 defining an outer peripheral wall 18. The wall 18 is dimensioned to frictionally engage the peripheral wall 14 of the compartment so as to permit removable attachment of the cover portion in overlying relation to the compartment 10. As shown in FIG. 8, the recessed area 17 also includes an extended area 19 defined by the extended wall section 20. This extended area 19 provides room for the reinforcement piece 21 which is formed in the stapler base 3 as reinforcement for the overlying die 6. A recessed area 22 is located between the reinforcement piece 21 and the front end 23 of the base 3 of the stapler. This recessed area 22 receives the end section 24 of the cover portion of the slipper. The recessed area 22 and the end 24 are dimensioned so that the end 24 is frictionally engaged between the reinforcement member 21 and the front end 23 of the stapler when the cover portion overlies the storage compartment.

The front end 23 of the base of the stapler, in addition to engaging the cover portion of the slipper, has a pointed shape. It is also tapered downwardly, when viewed from the side. With this construction, the end 23 provides a stapler remover for removing staples from stapled sheets of paper.

Figure 6:
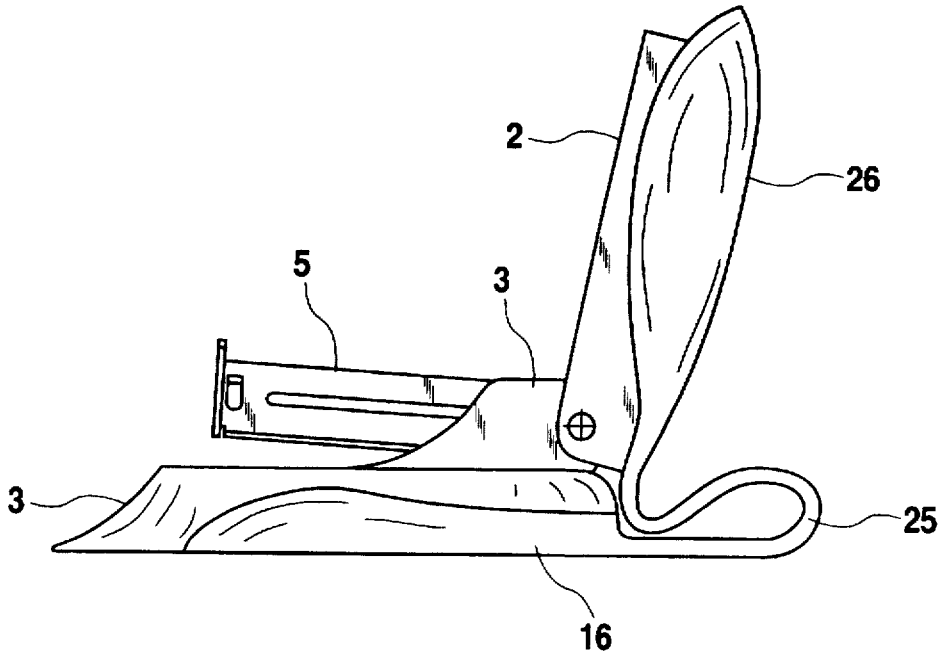
FIG. 6 is a side view of the stapler, pivoted to a open position for filling with staples.
Figure 7:
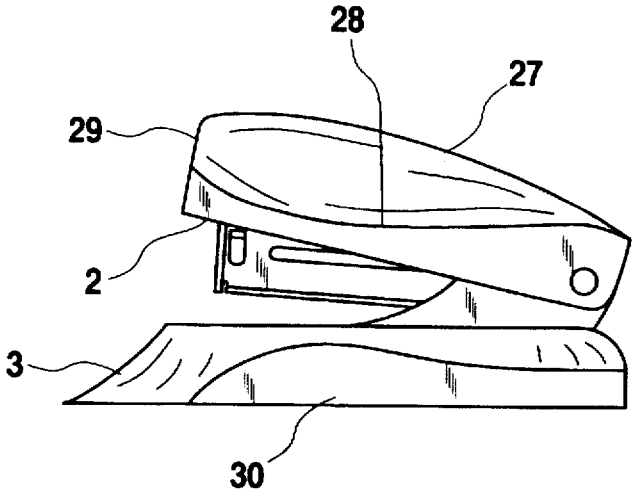
FIG. 7 is a side view of the stapler with the slipper removed.

The slipper 15 includes a loop portion 25 and a top portion 26. The loop portion extends around the end 4 of the stapler in space relationship therewith. As shown, it forms a smooth continuous curved configuration for connecting the cover and top portions of the slipper together. The loop portion is sufficiently flexible to permit pivoting of the stapler head 2 to an open position for filling the staple magazine 5, as shown in FIG. 6.

The slipper is secured to the stapler so that when the cover portion 16 is removed, to provide access to the storage compartment, the slipper is not accidentally lost or misplaced. In particular, the top portion 26 of the slipper is adhesively connected to the upper top surface 27 of the stapler head 2. As shown in the drawings, the upper top surface 27 is convexly curved and defines opposite peripheral side edges 28 and a front edge 29. The top portion 26 of the slipper extends beyond these peripheral edges. In addition, the cover portion of the slipper covers a lower section 30 of the opposite sides of the stapler base 3.

With the construction of the slipper as described, the stapler can be held in the hand with a comfortable feel. The rubber-like feel together with the compressibility of the material, provides a comfortable fit in the user's hand. The sides of the cover portion of the slipper can be easily engaged to bend the cover portion so as to remove it from overlying relation with the storage compartment.

We claim:

1. In a stapler having a head and a base, with the base including a top facing said head, opposite sides, and a bottom, and with the head and base being pivotally connected to each other at one end thereof, the improvement comprising:

a) a storage compartment in the bottom of said base; and b) a slipper having a cover portion removably attached in overlying relation to said compartment, said slipper further having a loop portion extending around said end of the stapler and a top portion connected in overlying relation to said head.

2. The stapler of claim 1, wherein the cover portion of said slipper is frictionally attached to said base.

3. The stapler of claim 1, wherein the top portion of said slipper is adhesively connected to the head of said stapler.

4. The improvement in the stapler according to claim 1, wherein said slipper is constructed of flexible material.

5. The stapler according to claim 4, wherein the slipper extends around said end of the stapler in spaced relation thereto.

6. The stapler according to claim 5, wherein the slipper extends in a smooth curve around said end of the stapler.

7. The improvement in the stapler according to claim 4, wherein said slipper is constructed of compressible material.

8. The stapler according to claim 7, wherein a) the head of said stapler has an upper top surface with peripheral side edges and a front edge; and b) the top portion of said slipper extends beyond the peripheral side edges and front edge of the top surface of said head.

9. The stapler according to claim 8, wherein the head of said stapler has an upper convexly curved top surface.

10. The stapler according to claim 9, wherein the cover portion of the slipper extends along said side of the base.

* * * * *